US011173534B2

(12) United States Patent
Schussheim

(10) Patent No.: US 11,173,534 B2
(45) Date of Patent: Nov. 16, 2021

(54) PRESS PUNCHING MACHINE AND RESPECTIVE METHOD OF PUNCHING APERTURES IN ELONGATED NONFERRIC ENCLOSED POLYGONALLY PROFILED WORKPIECES

(71) Applicant: SHOHAM MACHINERY LTD, Holon (IL)

(72) Inventor: Asher Schussheim, Ramat-Gan (IL)

(73) Assignee: SHOHAM MACHINERY LTD, Holon (IL)

( * ) Notice: Subject to any disclaimer, the term of this patent is extended or adjusted under 35 U.S.C. 154(b) by 0 days.

(21) Appl. No.: 16/504,299

(22) Filed: Jul. 7, 2019

(65) Prior Publication Data

US 2019/0329312 A1 Oct. 31, 2019

Related U.S. Application Data

(63) Continuation-in-part of application No. 15/742,796, filed as application No. PCT/IL2016/050736 on Jul. 7, 2016, now abandoned.

(30) Foreign Application Priority Data

Jul. 8, 2015 (IL) ..... 239843

(51) Int. Cl.
*B21D 28/28* (2006.01)
*B21D 28/00* (2006.01)
(Continued)

(52) U.S. Cl.
CPC ..... *B21D 28/28* (2013.01); *B21D 28/002* (2013.01); *B26F 1/14* (2013.01); *B21D 28/04* (2013.01)

(58) Field of Classification Search
CPC .. B21D 28/28; B21D 28/24–36; B21D 28/04; B21D 28/14; B21D 43/003; B21D 43/006; B21D 43/023; B21D 43/025; B21D 43/04; B21D 43/06; B21D 43/18; B21D 26/033–051; B21D 28/002; B26F 1/0015; B26F 1/0061; B26F 1/02–14;
(Continued)

(56) References Cited

U.S. PATENT DOCUMENTS 2,326,536 A 8/1943 Hartsock et al.
3,489,045 A 1/1970 Ray
(Continued)

FOREIGN PATENT DOCUMENTS

EP 2347837 7/2011
JP H07223028 8/1995

*Primary Examiner* — Evan H MacFarlane
(74) *Attorney, Agent, or Firm* — Mark David Torche; Patwrite Law

(57) ABSTRACT

A press punching machine and respective method of punching apertures in elongated non-ferric enclosed polygonally profiled workpieces are described. The press punching machine includes a base plate; a mounting framework; a driving mechanism; a male die; a pedestal; a polygonal female die matrix including: a polygonal cross-section; at least one counter-opening; at least one driven magnet; at least one indicatory magnet; at least one driving magnet configured to interact with the at least one driven magnet and a magnetic element configured to interact with the indicatory magnet embedded into the polygonal female punch die matrix.

4 Claims, 10 Drawing Sheets

(51) Int. Cl.
*B26F 1/14* (2006.01)
*B21D 28/04* (2006.01)

(58) Field of Classification Search
CPC ..... B26F 2001/4445; B26F 2001/4463; B26F 2001/4481; B26F 2001/449; B23D 33/02; B23D 33/10; Y10T 83/0596; Y10T 83/384–403; Y10T 83/9459
See application file for complete search history.

(56) References Cited

U.S. PATENT DOCUMENTS 3,620,115 A * 11/1971 Zieg ..... B21D 28/28 83/226
3,635,111 A * 1/1972 Zieg ..... B21D 28/28 83/183
6,601,492 B1 8/2003 Schusheim

* cited by examiner

PRESS PUNCHING MACHINE AND RESPECTIVE METHOD OF PUNCHING APERTURES IN ELONGATED NONFERRIC ENCLOSED POLYGONALLY PROFILED WORKPIECES

CROSS REFERENCE TO RELATED APPLICATIONS

The present application is a continuation-in-part of U.S. application Ser. No. 15/742,796 filed Jan. 8, 2018, which is US national phase of international application Ser. No. PCT/IL2016/050736 filed Jul. 7, 2016, which claims Paris convention priority from IL application Ser. No. 239843 filed Jul. 8, 2015.

INCORPORATION BY REFERENCE

The contents of aforesaid U.S. application Ser. No. 15/742,796, international application PCT/IL2016/050736 and IL application 239843 are incorporated herein in their entirety by this reference.

Moreover, the content of U.S. Pat. No. 6,601,492, to the inventor of the present invention, as well the contents of U.S. Pat. Nos. 3,620,115 and 3,635,111 to Wilhelm Zieg at al. are incorporated herein in their entirety by this reference.

TECHNICAL FIELD

In general, the present invention pertains to the arts of mechanics and machinery. In particular, the invention relates to a press punching machine and respective methods of punching apertures in elongated non-ferric enclosed polygonally profiled workpieces.

BACKGROUND OF THE INVENTION

Press punching is a well know technique for forming apertures in various workpieces. Press punching machine can be small and manually operated and hold one simple die set or be relatively large, with a multi-station turret and hold a much larger and complex die set. Most punch presses are relatively large machines with either a C-shaped type frame or a portal-bridge type frame. The C-type has a drive at the top foremost part, whereas the portal frame is much akin to a complete circle with the ram being centered within the frame to stop frame deflection or distortion.

It is believed that the prior art is inter alia represented by U.S. Pat. No. 6,601,492, disclosing a method and devices are disclosed for punching one or more holes in extruded hollow profiled bars where a back-up matrix must be inserted and located in precise alignment with the punching male punch die. Accordingly, the matrices are mounted to portable mandrel rods provided with settable stop brackets. The rods are placed in their exact operative punching position, and removed thereafter for processing the next bar. The method further provides for simultaneously punching holes in more than one wall of the profiled bars.

It is believed that the prior art is further represented by U.S. Pat. Nos. 3,620,115 and 3,635,111, disclosing an apparatus for making perforations in helically or circumferentially corrugated plastic tubes has flat plate-like perforating tools which are movable radially toward and away from the tube, a feeding mechanism which advances the tube, either intermittently or continuously, and driven carriers which support the tools and are movable radially of the tube or in planes which include the axis of the tube. Each tool has a cutting edge which is formed with pronounced teeth having tips located at the same level or at different levels. The tube is internally supported at the perforating station and is guided by a channel on its way toward the perforating station.

SUMMARY OF THE INVENTION

In accordance with some embodiments of the present invention, a press punching machine, for punching apertures in elongated non-ferric enclosed polygonally profiled workpieces, is provided.

In accordance with some embodiments of the present invention, the press punching machine includes: (a) an essentially plain base plate; (b) a mounting framework firmly attached to the base plate; (c) a driving mechanism firmly attached to the mounting framework; (d) at least male die operatively connected to the driving mechanism; (e) a pedestal, attached to the base plate, the pedestal is configured to support an elongated non-ferric enclosed polygonally profiled workpiece during punching operation, (f) a polygonal female die matrix and (g) at least one driving magnet configured to interact with the at least one driven magnet embedded into the side portion of the polygonal female die matrix, the at least one driving magnet is embedded into a back-side plate of the press punching machine or the pedestal.

In accordance with some embodiments of the present invention, the polygonal female die matrix includes: (I) a polygonal cross-section configured to conform to at least a substantial portion of an interior cross-section of the elongated non-ferric enclosed polygonally profiled workpiece; (II) at least one counter-opening, configured to receive the at least male die during punching operation; (III) at least one driven magnet embedded into a side portion of the polygonal female die matrix, configured to drive the polygonal female die matrix within the elongated non-ferric enclosed polygonally profiled workpiece.

In accordance with some preferred embodiments of the present invention, the polygonal female die matrix further includes at least one indicatory magnet embedded into a side portion of the polygonal female die matrix, configured to provide an indication about the polygonal female die matrix within the elongated non-ferric enclosed polygonally profiled workpiece, as well as at least one magnetic element selected form the group consisting of: a magnetically sensitive element and magnetically interactive element; the at least one magnetic element is configured to interact with or be actuated by the at least one indicatory magnet embedded into the side portion of the polygonal female punch die matrix;

In accordance with some preferred embodiments upon threading the polygonal female die matrix into the elongated non-ferric enclosed polygonally profiled workpiece, the at least one driven magnet embedded into the side portion of the polygonal female die matrix interacts with the at least one driving magnet embedded into the at least one component selected form the group consisting of: the back-side of the press punching machine and the pedestal; in which upon the interaction between the at least one driven magnet with the at least one driving magnet, the polygonal female die matrix is driven within the elongated non-ferric enclosed polygonally profiled workpiece into a correct position, in which the at least one counter-opening in the polygonal female die matrix is aligned vis-à-vis the at least male die.

In accordance with some preferred embodiments upon driving the polygonal female die matrix, within the elongated non-ferric enclosed polygonally profiled workpiece, into the correct position, the at least one magnetic element interacts with and/or actuated by the at least one indicatory magnet, embedded into a side portion of the polygonal female die matrix; thereby providing an indicatory confirmation that the at least one counter-opening in the polygonal female die matrix is aligned vis-à-vis the at least male die.

In accordance with some embodiments of the present invention, the at least one driving magnet is embedded into the back-side plate of the press punching machine and at least one driven magnet is embedded, is a lateral side portion of the polygonal female die matrix.

In some embodiments of the press punching machine, the at least one driving magnet is oriented essentially orthogonally to the at least one male die.

In some embodiments of the press punching machine, the at least one indicatory magnet is oriented essentially orthogonally to the at least one male die.

In some embodiments the press punching machine is configured to perform double-sided punching, by a set of at least two male dies, simultaneously from opposite lateral faces of the elongated non-ferric enclosed polygonally profiled workpiece.

In some embodiments the press punching machine is configured to perform triple-sided punching, by a set of at least three male dies, simultaneously from opposite lateral and top faces of the elongated non-ferric enclosed polygonally profiled workpiece.

In some embodiments of the press punching machine, the at least one driving magnet is embedded into the pedestal and in which the side portion of the polygonal female die matrix, into which the at least one driven magnet is embedded, is a bottom side portion of the polygonal female die matrix.

In some embodiments of the press punching machine, the at least one driving magnet is oriented essentially paralleling to the at least one male die.

In some embodiments of the press punching machine, the at least one indicatory magnet is oriented essentially paralleling to the at least one male die.

In some embodiments of the press punching machine, the at least one driving magnet is an electromagnet.

In some embodiments of the press punching machine, the at least one magnetic element is selected from the group consisting of: a counterpoising magnet, magnetic sensor, electromagnetic sensor and electromechanical magnetic sensor.

In some embodiments of the press punching machine, the polygonal female punch die matrix includes an inferior groove configured to accommodate stamped wall pieces of the elongated non-ferric enclosed polygonally profiled workpiece, removed from the counter-opening, following at least one punching cycle.

In some embodiments the press punching machine includes a mechanism configured to prevent activation of the press punching machine, whilst the at least one magnetic element is not manipulated by the at least one indicatory magnet.

In accordance with some embodiments of the present invention, a method of press punching apertures in elongated non-ferric enclosed polygonally profiled workpieces is provided.

In accordance with some embodiments of the present invention, the method of press punching apertures includes: (a) providing a press punching including: (I) at least male die operatively connected to a driving mechanism, (II) a pedestal configured to support an elongated non-ferric enclosed polygonally profiled workpiece during punching operation, (III) at least one driving magnet configured to interact with the at least one driven magnet embedded into the side portion of the polygonal female die matrix; and (IV) a polygonal female die matrix.

In accordance with some embodiments of method of the present invention, the polygonal female die matrix including: (i) a polygonal cross-section conforming to at least a substantial portion of an interior cross-section of the elongated non-ferric enclosed polygonally profiled workpiece; (ii) at least one counter-opening, configured to receive the at least male die during punching operation; (iii) at least one driven magnet embedded into a side portion of the polygonal female die matrix.

In accordance with some embodiments of method of the present invention, the press punching machine includes at least one indicatory magnet embedded into a side portion of the polygonal female die matrix, configured to provide an indication about the polygonal female die matrix, as well as at least one magnetic element selected form the group consisting of: a magnetically sensitive element and magnetically interactive element; the at least one magnetic element is configured to be manipulated by the at least one indicatory magnet.

In accordance with some embodiments of the present invention, the method of press punching apertures further includes: (b) threading the polygonal female die matrix into the elongated non-ferric enclosed polygonally profiled workpiece; (c) adjoining the elongated non-ferric enclosed polygonally profiled workpiece to the least one driving magnet; (d) exerting a force onto the at least one driven magnet embedded into the side portion of the polygonal female die matrix by the at least one driving magnet and driving the polygonal female die matrix into a correct position, in which the at least one counter-opening in the polygonal female die matrix is aligned vis-à-vis the at least male die; (e) longitudinally translating the elongated non-ferric enclosed polygonally profiled workpiece relatively to the press punching machine, whereby the polygonal female die matrix is longitudinally translated within the elongated non-ferric enclosed polygonally profiled workpiece, whilst remaining essentially immobile relatively to the press punching machine.

In accordance with some embodiments of the present invention, the method of press punching apertures yet further includes: manipulating the at least one magnetic element by the at least one indicatory magnet, embedded into a side portion of the polygonal female die matrix, thereby providing an indication that the polygonal female die matrix is at the correct position, in which the at least one counter-opening in the polygonal female die matrix is aligned vis-à-vis the at least male die.

In some embodiments the method further includes embedding the at least one driving magnet into a back-side plate of the press punching machine.

In some embodiments the method further includes positioning the at least one driving magnet essentially orthogonally to the at least one male die.

In some embodiments the method further includes positioning the at least one indicatory magnet essentially orthogonally to the at least one male die.

In some embodiments the method further includes performing double-sided punching, by a set of at least two male dies, simultaneously from opposite lateral faces of the elongated non-ferric enclosed polygonally profiled workpiece.

In some embodiments the method further includes performing triple-sided punching, by a set of at least three male dies, simultaneously from opposite lateral and top faces of the elongated non-ferric enclosed polygonally profiled workpiece.

In some embodiments the method further includes embedding the at least one driving magnet into the pedestal.

In some embodiments the method further includes positioning the at least one driving magnet essentially in parallel to the at least one male die.

In some embodiments the method further includes positioning the at least one indicatory magnet essentially in parallel to the at least one male die.

In some embodiments of the method the at least one driving magnet of the press punching machine is an electromagnet.

In some embodiments of the method the at least one magnetic element is selected from the group consisting of: a counterpoising magnet, magnetic sensor, electromagnetic sensor and electromechanical magnetic sensor.

In some embodiments the method further includes forming an inferior groove in the polygonal female punch die matrix accommodating stamped wall pieces of the elongated non-ferric enclosed polygonally profiled workpiece, removed from the counter-opening, following at least one punching cycle.

In some embodiments the method further includes preventing operation of the press punching machine, if the at least one magnetic element is not manipulated by the at least one indicatory magnet.

Definitions

The term non-ferric, as referred to herein, shall be construed as including any type of material consisting essentially not of iron, in a non-limiting manner including any nonferrous metals and alloys as well as any polymeric materials or plastics.

The term elongated, as referred to herein, shall be construed as typically exceeding several dozens of centimeters but typically preceding several dozens of meters.

The term enclosed, as referred to herein, shall be construed as forming or defining an interior lumen.

The term polygonally profiled, as referred to herein, shall be construed as including any workpiece having an essentially uniform profile, such as inter alia any extruded bars or profiles, the cross-section of which is characterized by an enclosed polygonal shape.

The term non-ferric elongated enclosed polygonally profiled workpiece, as referred to herein, shall be construed as including any workpiece having an essentially uniform profile, such as inter alia any extruded bars or profiles, the cross-section of which is characterized by an enclosed polygonal shape.

The term non-ferric elongated enclosed polygonally profiled workpiece, as referred to herein, shall be construed in a non-limiting manner as particularly including extruded profiles made of aluminum and alloys thereof used in construction.

BRIEF DESCRIPTION OF THE DRAWINGS

The present invention will be understood and appreciated more comprehensively from the following detailed description taken in conjunction with the appended drawings in which.

DETAILED DESCRIPTION OF THE INVENTION

Figure 1A:
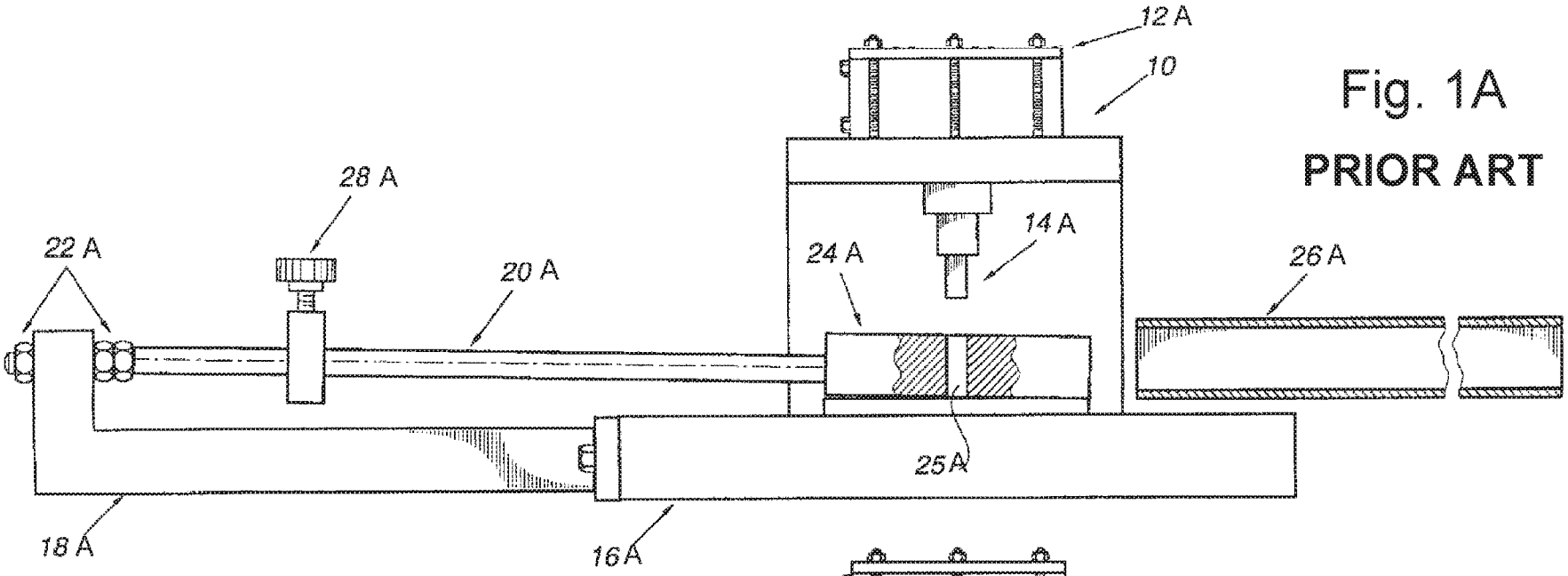
Fig. 1A PRIOR ART
FIG. 1A is a front view of a pneumatically driven press punching machine known in the art.

Prior to elaborating any complete embodiment of the present inventive concept, in order to present important enabling constituents of the invention in sufficient details, reference is firstly made to FIGS. 1A to 1D, which are FIGS. 1a-1d of U.S. Pat. No. 6,601,492, schematically illustrating the traditional, state of the art technique of press punching extruded bars. In FIG. 1A there is shown a punching press device generally denoted 10 of known construction, provided with pneumatic drive mechanism 12A powered by a cylinder and piston unit and male punch 14A.

To base plate 16A of the device 10 there is connected a generally L-shaped extension bar 18A to which a mandrel rod 20A is fixedly connected, by bolts 22A. The mandrel rod 20A carries at its free end female punch die 24A, hereinafter the female punch matrix, with counter-opening 25A, configured to back-up extruded profile 26A during the punching operation. The mandrel rod 20A is provided with a fixable stop bracket 28A for setting the distance of the punched opening from the end of processed profiled bar 26A.

Figure 1B:
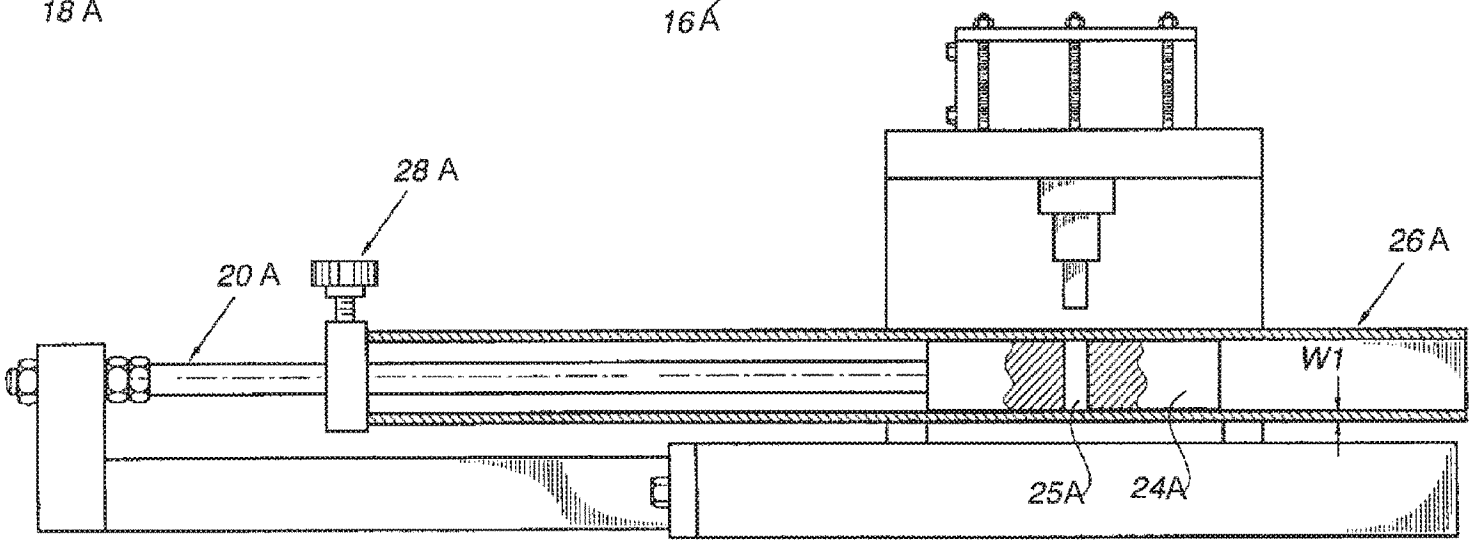
Fig. 1B PRIOR ART
FIG. 1B is a front view of the pneumatically driven press punching machine known in the art, loaded with a workpiece.

It will be noted that the mandrel rod 20A is somewhat flexible and normally, when not in operation, it extends at a certain angle relative to the horizontal slanting in the direction of the punching press 10. However, when the extruded profiled bar 26A is threaded over the matrix 24A, as seen in FIG. 1B, the rod 20A becomes precisely aligned, namely slightly raised by the lower wall width W1 of the bar 26A. This will ensure that the male punch 14A and the female back-up die are in exact vertical alignment with respect to each other to ensure a clean cut of the opening.

Figure 1C:
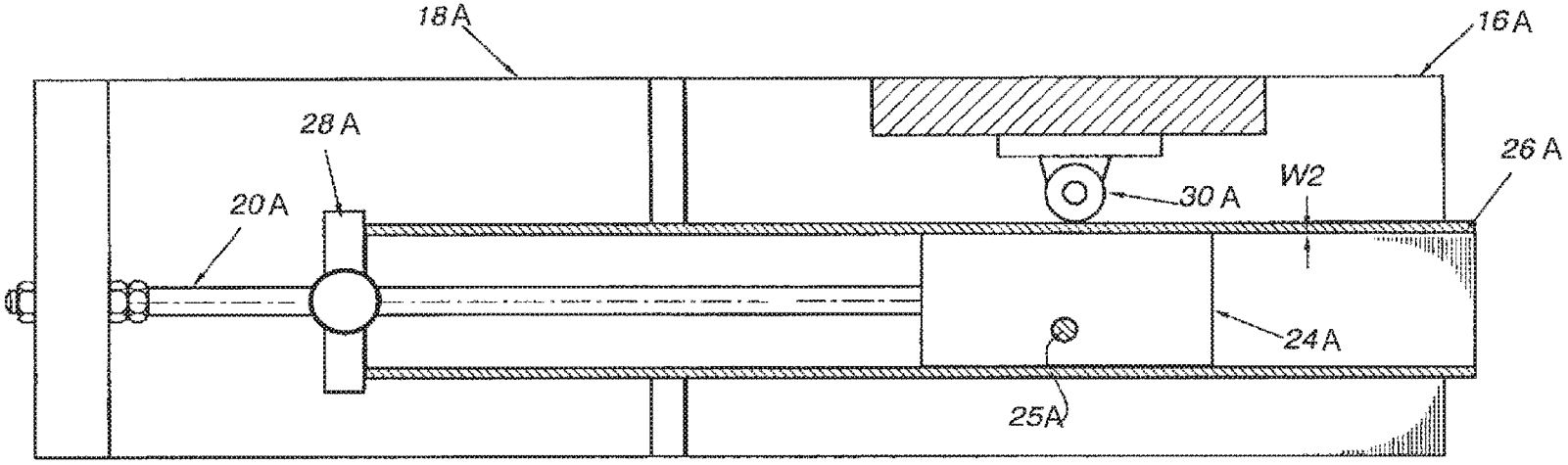
Fig. 1C PRIOR ART
FIG. 1C is a top view of the pneumatically driven press punching machine known in the art.
Figure 1D:
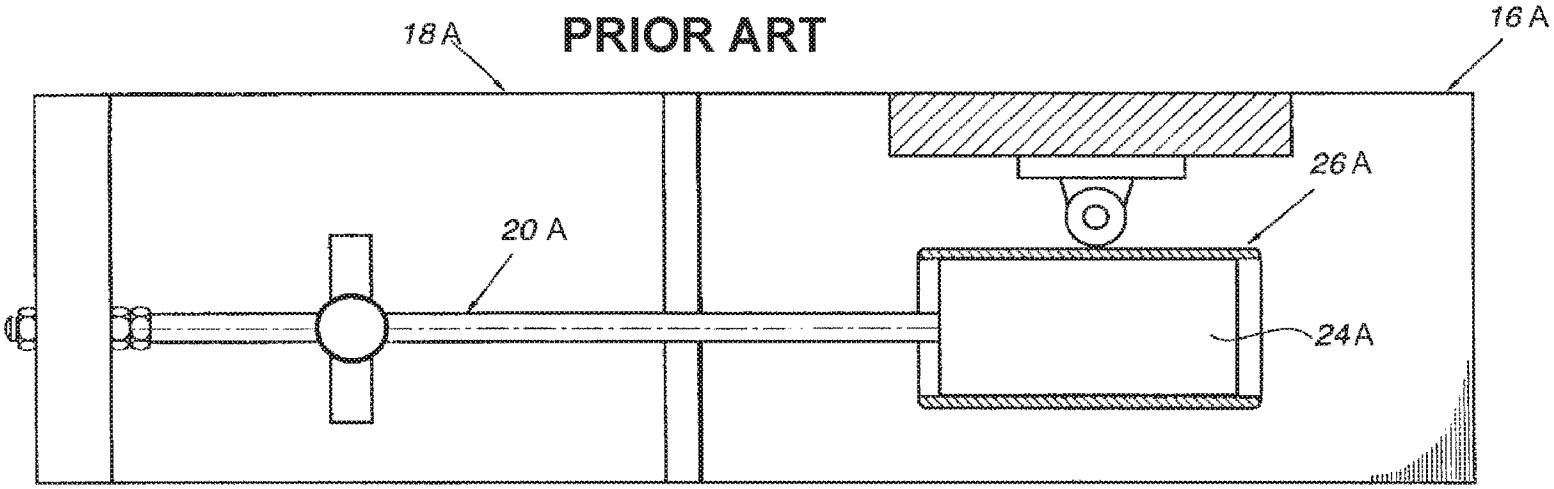
Fig. 1D PRIOR ART
FIG. 1D is a top view of the pneumatically driven press punching machine known in the art, loaded with a workpiece.
Figure 1E:
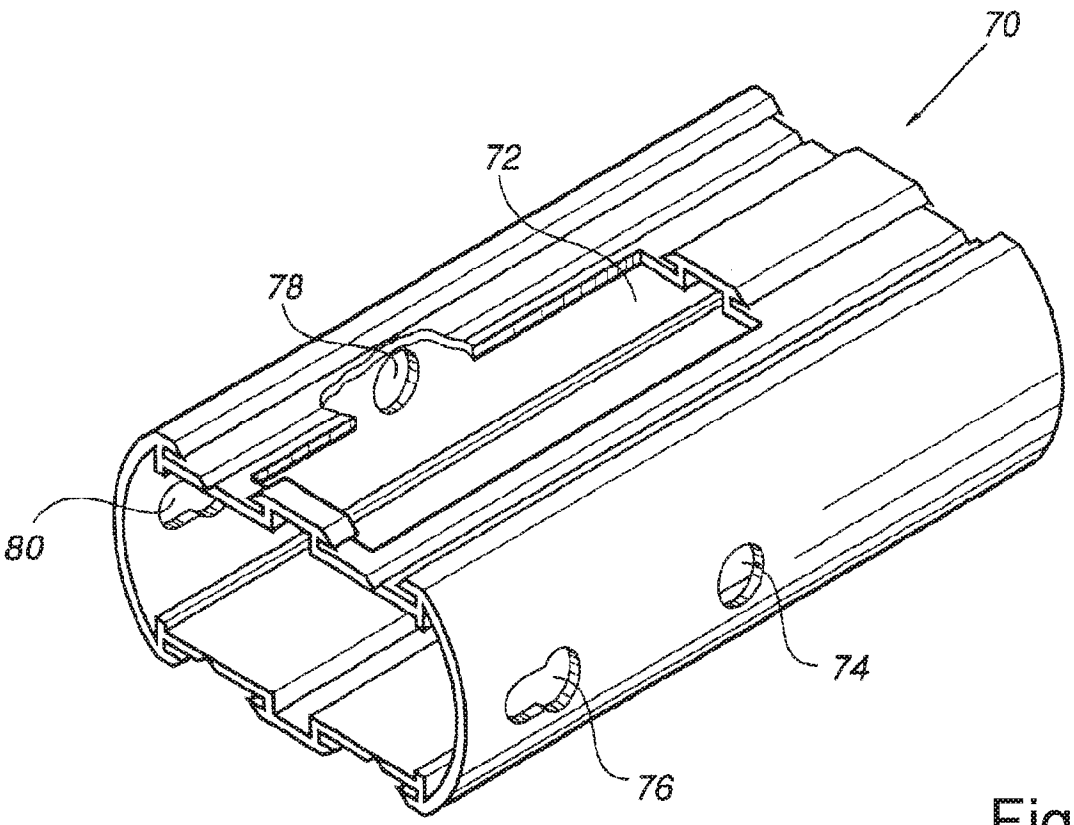
Fig. 1E PRIOR ART
FIG. 1E is an isometric view of a workpiece known in the art.
Figure 1F:
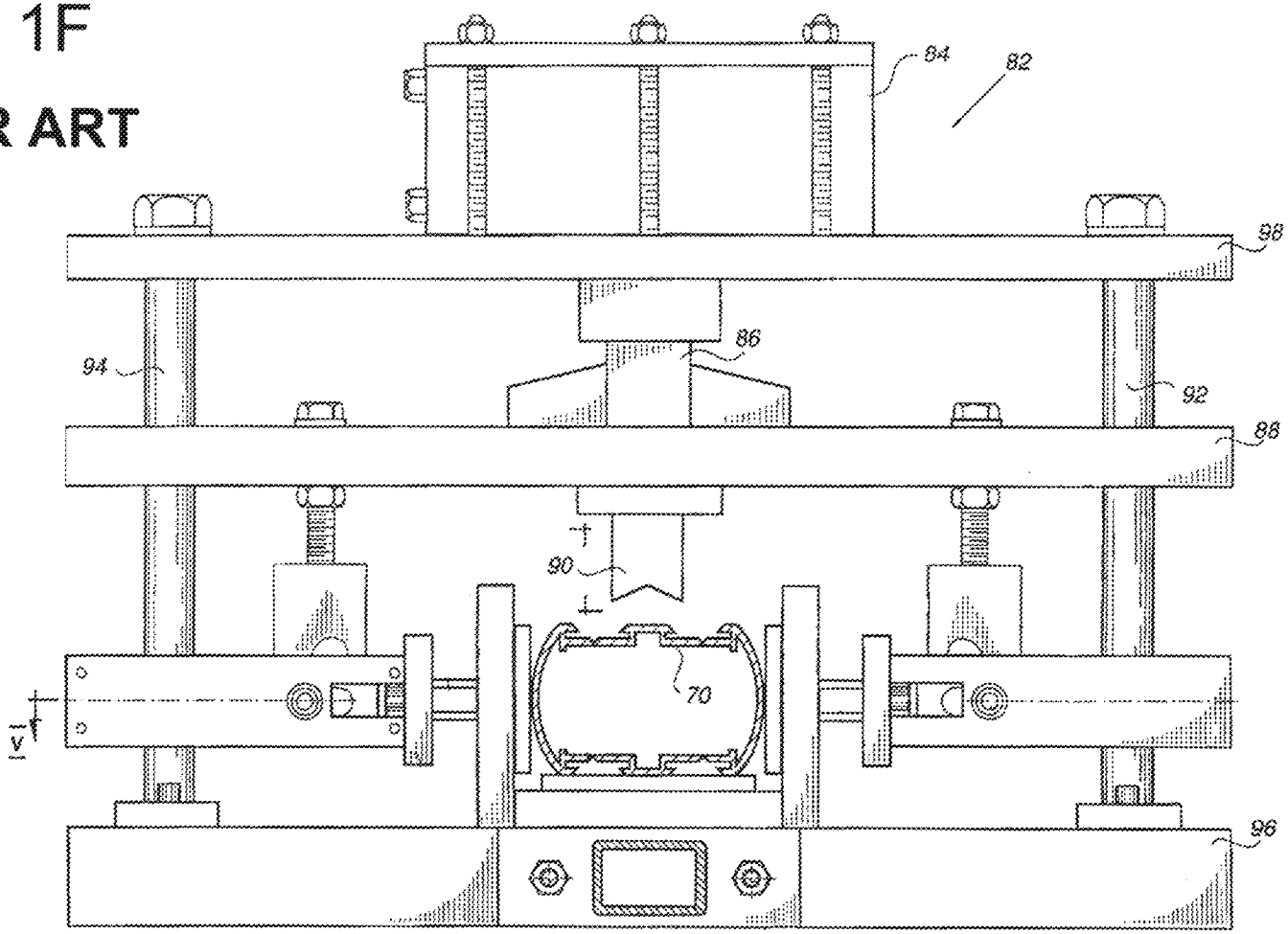
Fig. 1F PRIOR ART
FIG. 1F is a front view of the pneumatically driven press punching machine known in the art, loaded with a workpiece.
Figures 2A, 2B:
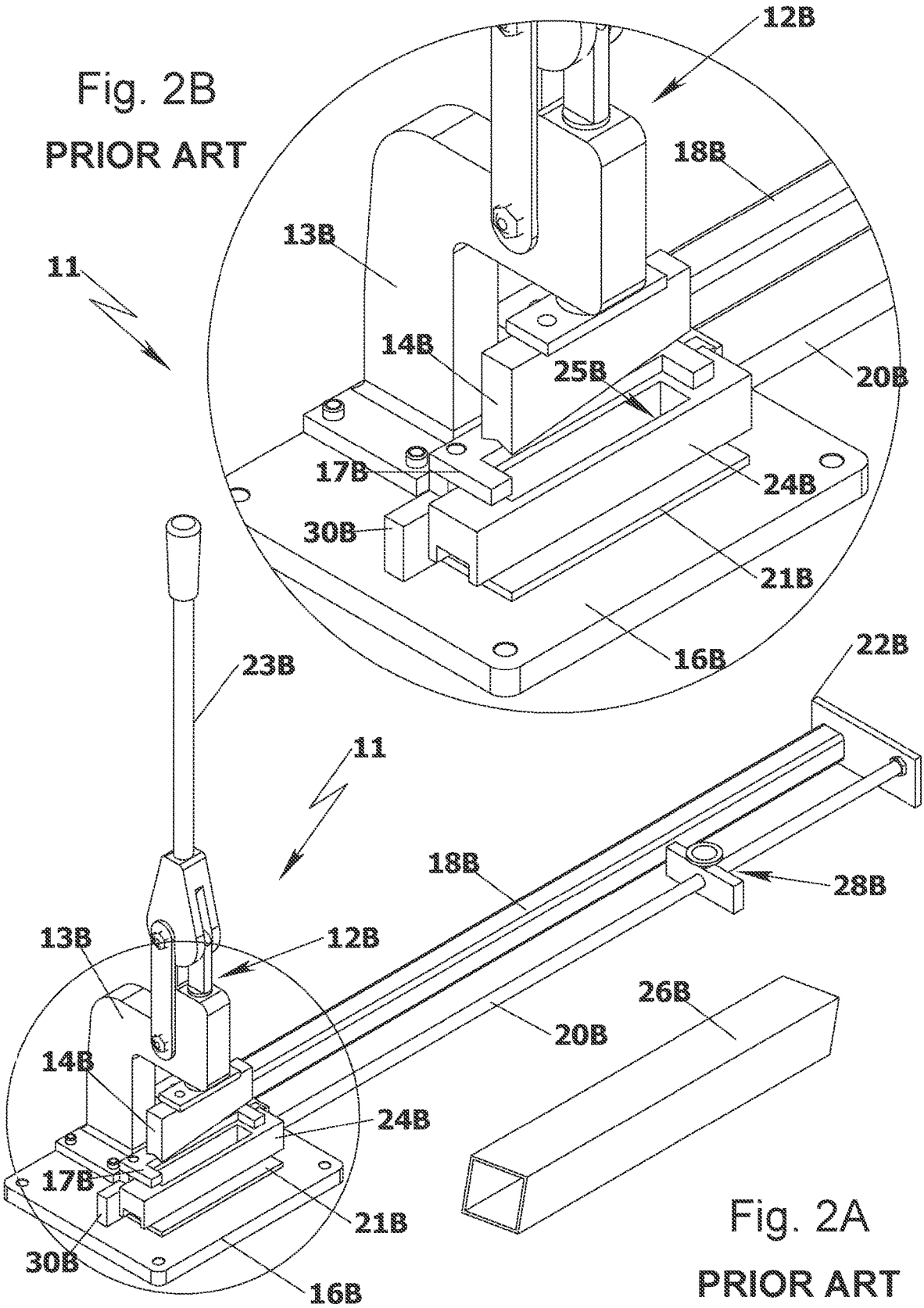
Fig. 2B PRIOR ART
Fig. 2A PRIOR ART
FIG. 2A is an isometric view of yet another manually driven press punching machine known in the art, for punching apertures in elongated enclosed profiled workpieces.
FIG. 2B is an enlarged isometric view of a portion of the manually driven press punching machine known in the art, for punching apertures in elongated enclosed profiled workpieces.
Figures 2C, 2D:
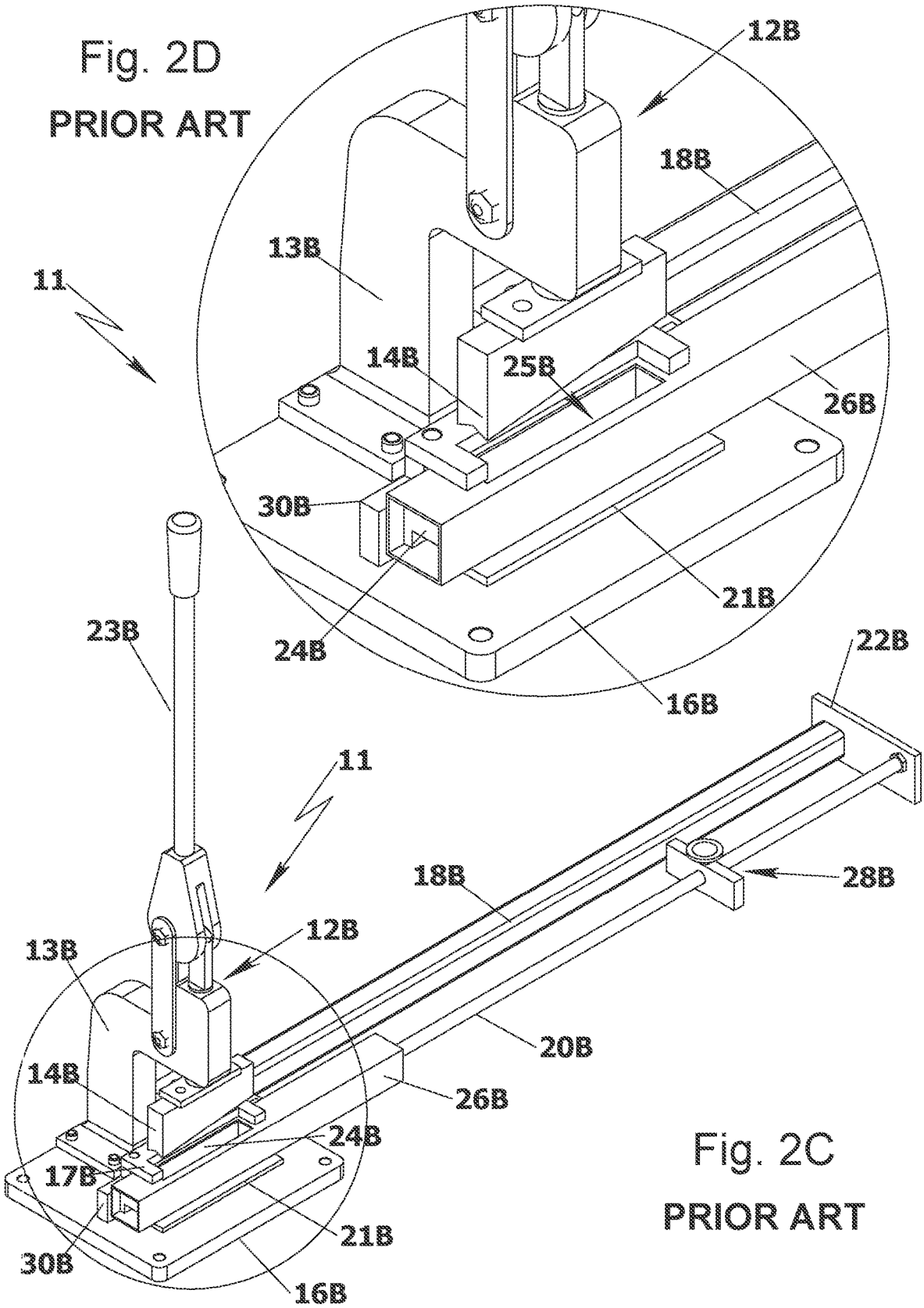
Fig. 2D PRIOR ART
Fig. 2C PRIOR ART
FIG. 2C is an isometric view of the manually driven press punching machine known in the art, for punching apertures in elongated enclosed profiled workpieces, loaded with a workpiece.
FIG. 2D is an enlarged isometric view of a portion of the manually driven press punching machine known in the art, for punching apertures in elongated enclosed profiled workpieces, loaded with a workpiece.

As evident from FIG. 1C, the horizontal alignment or location of the matrix 24A is ensured by a roller or the equivalent device 30A the location thereof again takes into account the side wall width W2 of the bar 26A. Reference is now made to FIGS. 1E and 1F, which are FIGS. 3 and 4 of U.S. Pat. No. 6,601,492. As evident from FIG. 1E extruded bar generally denoted 70, of the shape vastly used in the construction of doors made of profiled aluminum extruded bars. Bar 70 must be formed with a rectangular opening 72 at its top wall; a first, circular opening 74 and a second keyhole shaped opening 76 at one-side wall; and symmetrically opposite openings 78 and 80 at the other side wall of the bar 70. FIG. 1F illustrates a press punch device 82 useful for carrying out the operation of punching out the openings 72, 74, 76, 78 and 80 extruded bar 70, shown in FIG. 1E in a single high precision operation. Thus, punching press device 82 comprises a pneumatic cylinder unit 84 for operating piston rod 86 which causes the reciprocating movement of cross plate 88. This movement is transferred to male punch 90, suitably shaped for cutting the opening 72, shown in FIG. 1E, of extruded bar 70, and also to a pair of side or lateral punches. The reciprocable cross plate 88 is guided by pair of columns 92 and 94 which are affixed to base plate 96 at the bottom side and carrying top plate 98 at the other side.

These principles of construction and working process are common to existing punching presses as known now for decades. These devices, however, suffer from a drawback. It is generally inconvenient and time-consuming to insert the sometimes quite long profiled bars 26A into the operative position of FIG. 1B, bearing in mind that only small tolerances must be left between the inner cross-section of the bar 26A and the outer shape of the female matrix 24A.

In order to evaluate the contribution to the art of the present invention yet further, reference is now made to FIGS. 2A to 2D, illustrating in more details yet another traditional, state of the art technique of press punching extruded profiled workpieces. In FIGS. 2A to 2D there is shown a punching press device generally denoted 11 of a known construction, namely provided with a manual drive mechanism 12B and male punch 14B.

Manual drive mechanism 12B is mounted on C-arm 13B and operated by handle 23B. To base plate 16B of device 11 there is connected a generally L-shaped extension bar 18B to which a mandrel rod 20B is fixedly connected, by fixture 22B. The mandrel rod 20B carries at its free end female punch die matrix 24B, with counter-opening 25B configured to back-up extruded profile 26B during the punching operation. The mandrel rod 20B is provided with a fixable stop bracket 28B for setting the distance of the punched opening from the end of processed profiled bar 26B.

Base plate 16B of device 11 further carries pedestal 21B, configured to support the extruded profile 26B during the punching operation. Device 11 is further provided with back-side plate 30B, which acts as a stopper and assisting to position and align profiled bar 26B horizontally for the punching operation. Device 11 is further provided with top-side plate 17B, which acts as a stopper and assisting to position and align profiled bar 26B vertically for the punching operation.

Illustrative embodiments of the invention are described below. In the interest of clarity, not all features of actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming, but would nevertheless be a routine undertaking for those of ordinary skill in the art having the benefit of this disclosure.

In accordance with some embodiments of the present invention, reference is now made to FIGS. 3 to 5B, showing manually driven press punching machine 40, configured for punching apertures in elongated non-ferric enclosed polygonally profiled workpieces. Manually driven press punching machine 40 for punching apertures in elongated non-ferric enclosed polygonally profiled workpieces, shown in FIGS. 3 to 5B, comprises male die 14. Male die 14 of manually driven press punching machine 40 embodies an exemplary shape configured for punching apertures comprising an essentially plain rectangular shape. It would be appreciated however that a plurality of male dies (not shown) embodying a much complex shape configured for punching apertures comprising exceedingly complex geometry, inter alia including arcuate edges, is equally contemplated within the scope of the present disclosure.

Manually driven press punching machine 40, comprises manual drive mechanism 12 is mounted on C-arm 13 and operated by handle 23. Base plate 16 of device 40 further carries pedestal 21, configured to support elongated non-ferric enclosed polygonally profiled workpiece 26 during the punching operation. Pedestal 21 of device 40 optionally comprises a plain or structured surface configured to conform to the bottom face of an elongated non-ferric enclosed polygonally profiled workpiece. In some preferred embodiments pedestal 21 is removably attachable to and detachable from base plate 16. Pedestal 21 of device 40 is optionally comprises a mechanism (not shown) for adjustably setting the height of pedestal 21 relatively to base plate 16. Device 40 is further provided with top-side plate 17, which acts as a stopper and assisting to position and align profiled bar 26 vertically for the punching operation.

There is no L-shaped extension connected to base plate 16 as well as there is no bar to which a mandrel rod carrying the polygonal female punch die matrix 44, shown in FIGS. 4A to 5B, as opposed to the prior art devices employing an L-shaped extension and mandrel rod, such as L-shaped extension 18B and mandrel rod 20B shown in FIGS. 2A to 2D. Device 40 is instead provided with back-side plate 30, acting as a stopper and assisting to position and align elongated non-ferric enclosed polygonally profiled workpiece 26 horizontally for the punching operation. Back-side plate 30 of device 40 incorporates a plurality of magnets 42, shown in HG 3, used to position and align elongated non-ferric enclosed polygonally profiled workpiece 26. It is noted that in prior art devices, the female punch die matrix, such as matrix 24B shown in FIGS. 2A to 2D, is typically iron made. However, in accordance with the present invention, polygonal female punch die matrix 44, shown in FIGS. 4A to 5B, is typically made of an essentially non-ferric material, as defined hereinabove.

Polygonal female punch die matrix 44, shown in FIGS. 4A to 5B, embodies a polygonally profiled shape, respectively matching the interior of elongated non-ferric enclosed polygonally profiled workpiece 26. In the example of device 40, polygonal female punch die matrix 44, shown in FIGS. 4A to 5B, embodies an essentially rectangular outer shape, respectively matching the interior of plain rectangular elongated non-ferric profiled workpiece 26. Polygonal female punch die matrix 44 comprises counter-opening 25 configured to receive the male punch die 14 during the punching operation. In other examples, however (not shown), device 40 comprises a polygonal female punch die matrix (not shown), embodying a more complicated shape than the essentially rectangular outer shape of polygonal female punch die matrix 44, respectively matching the interior of plain rectangular elongated non-ferric profiled workpiece 26.

Polygonal female punch die matrix 44, shown in FIGS. 4A to 5B, further comprises inferior groove 45, used to accommodate the stamped wall pieces removed from the counter-opening 25, following one or several consecutive punching cycles, performed on elongated non-ferric enclosed polygonally profiled workpiece 26. Polygonal female punch die matrix 44, shown in FIGS. 4A to 5B, further incorporates a plurality of magnets 52, positioned within the side portion of polygonal female punch die matrix 44, shown in FIGS. 4A to 5B, facing back-side plate 30 of device 40, in a similar arrangement to magnets 42, shown in FIG. 3.

Figure 3:
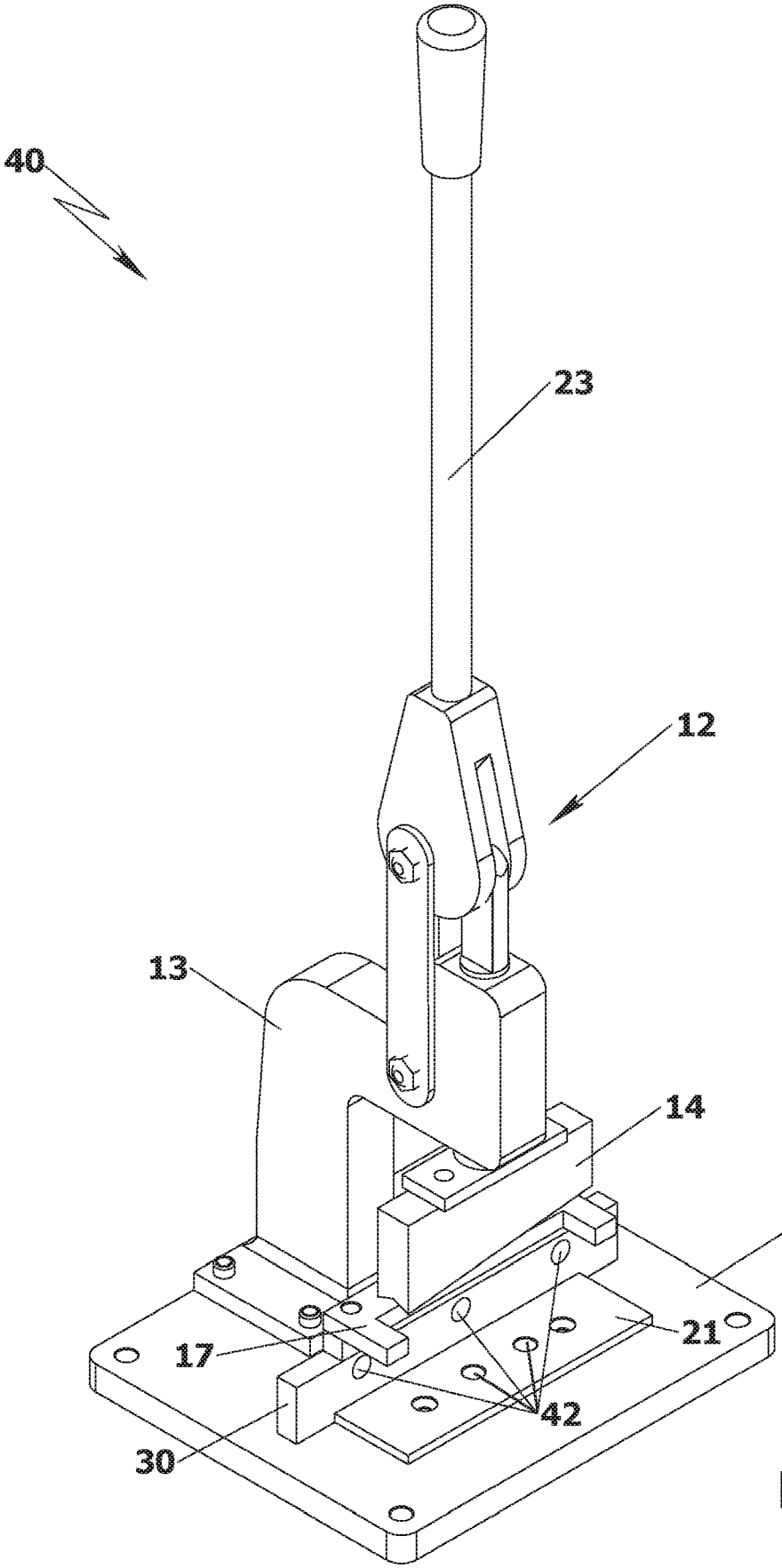
FIG. 3 is an isometric view of the manually driven press punching machine in accordance with some embodiments of the present invention, for punching apertures in elongated enclosed profiled workpieces, without the female die matrix.
Figure 4B:
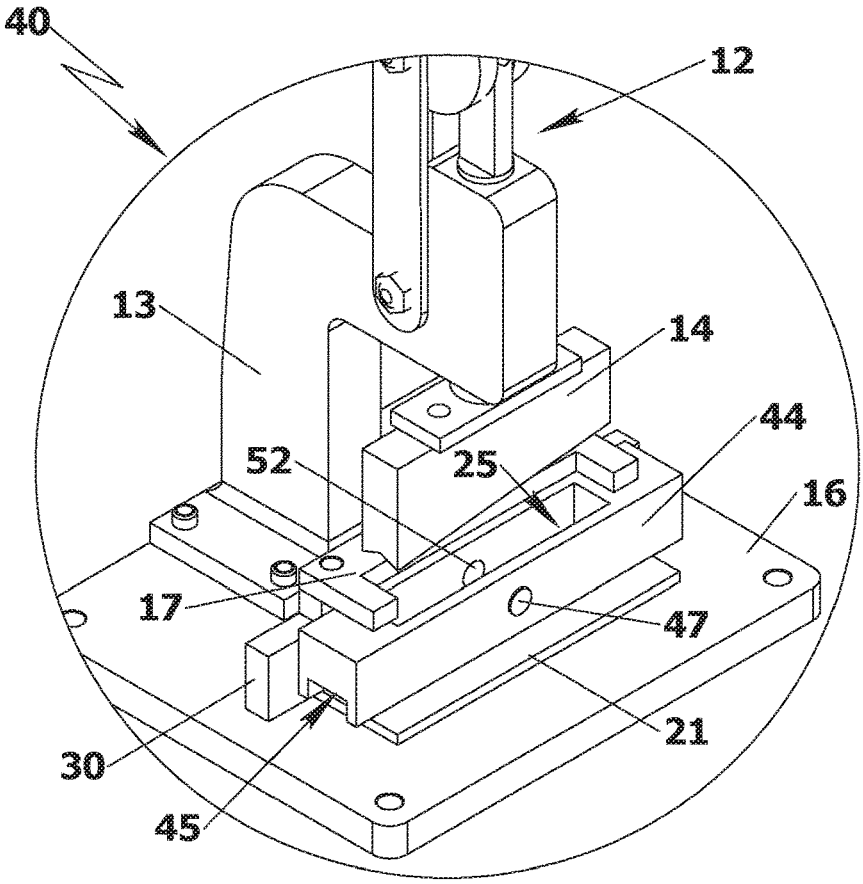
FIG. 4B is an enlarged isometric view of a portion of the manually driven press punching machine in accordance with some embodiments of the present invention, for punching apertures in elongated enclosed profiled workpieces, with the female die matrix.
Figure 4A:
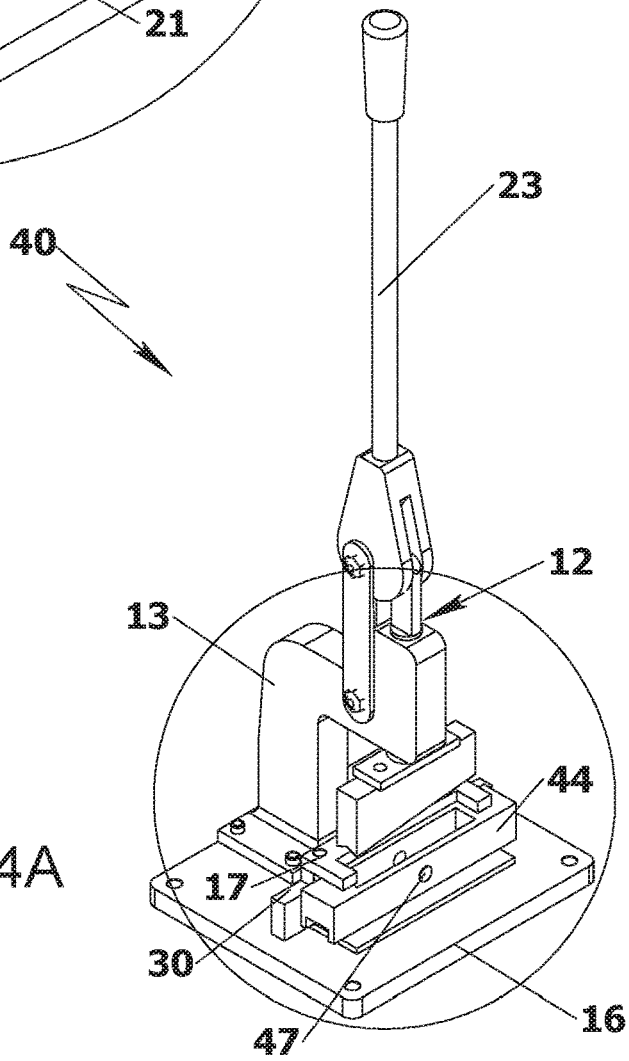
FIG. 4A is an isometric view of the manually driven press punching machine in accordance with some embodiments of the present invention, for punching apertures in elongated enclosed profiled workpieces, with the female die matrix.
Figure 5A:
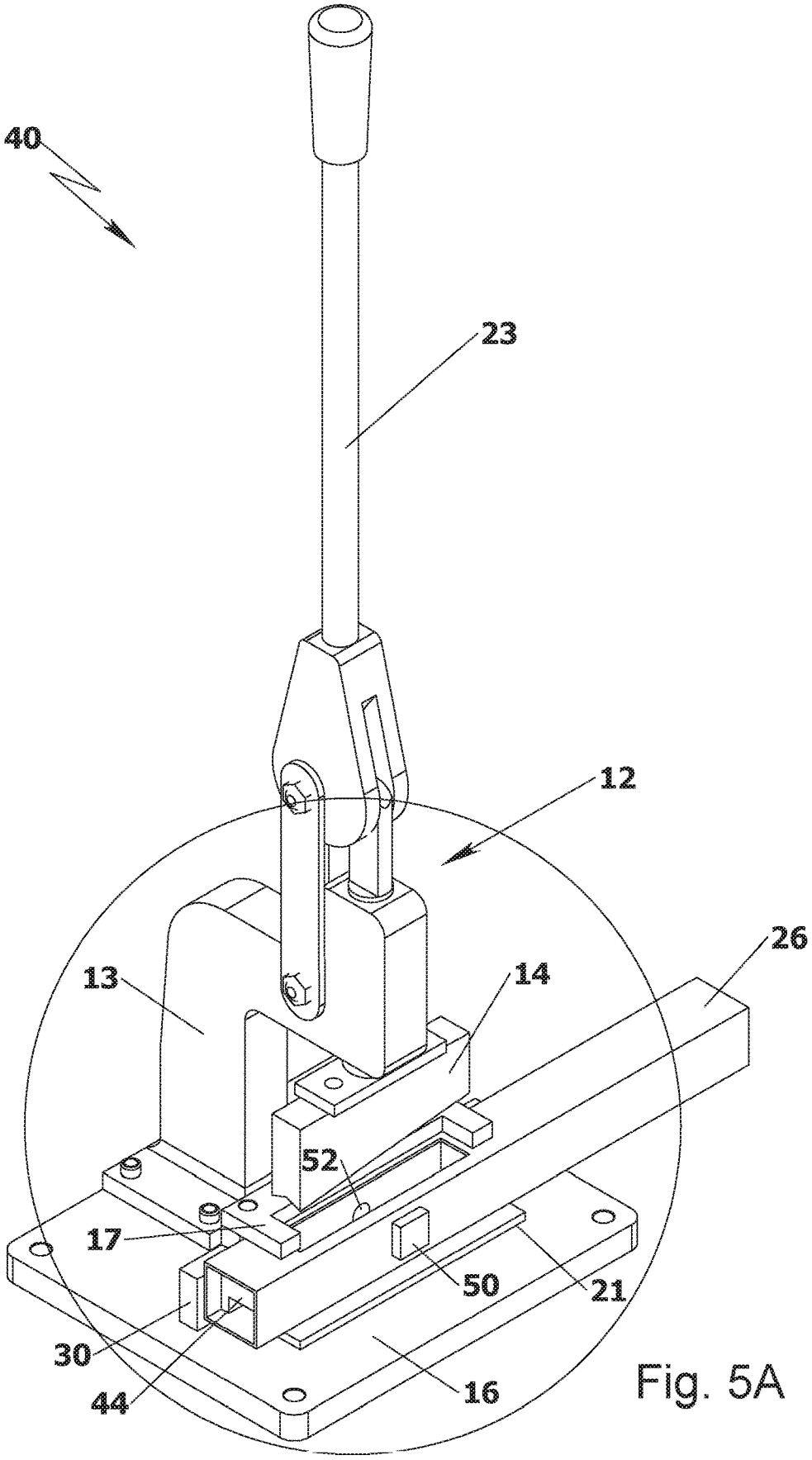
FIG. 5A is an isometric view of the manually driven press punching machine in accordance with some embodiments of the present invention, for punching apertures in elongated enclosed profiled workpieces, loaded with a workpiece.
Figure 5B:
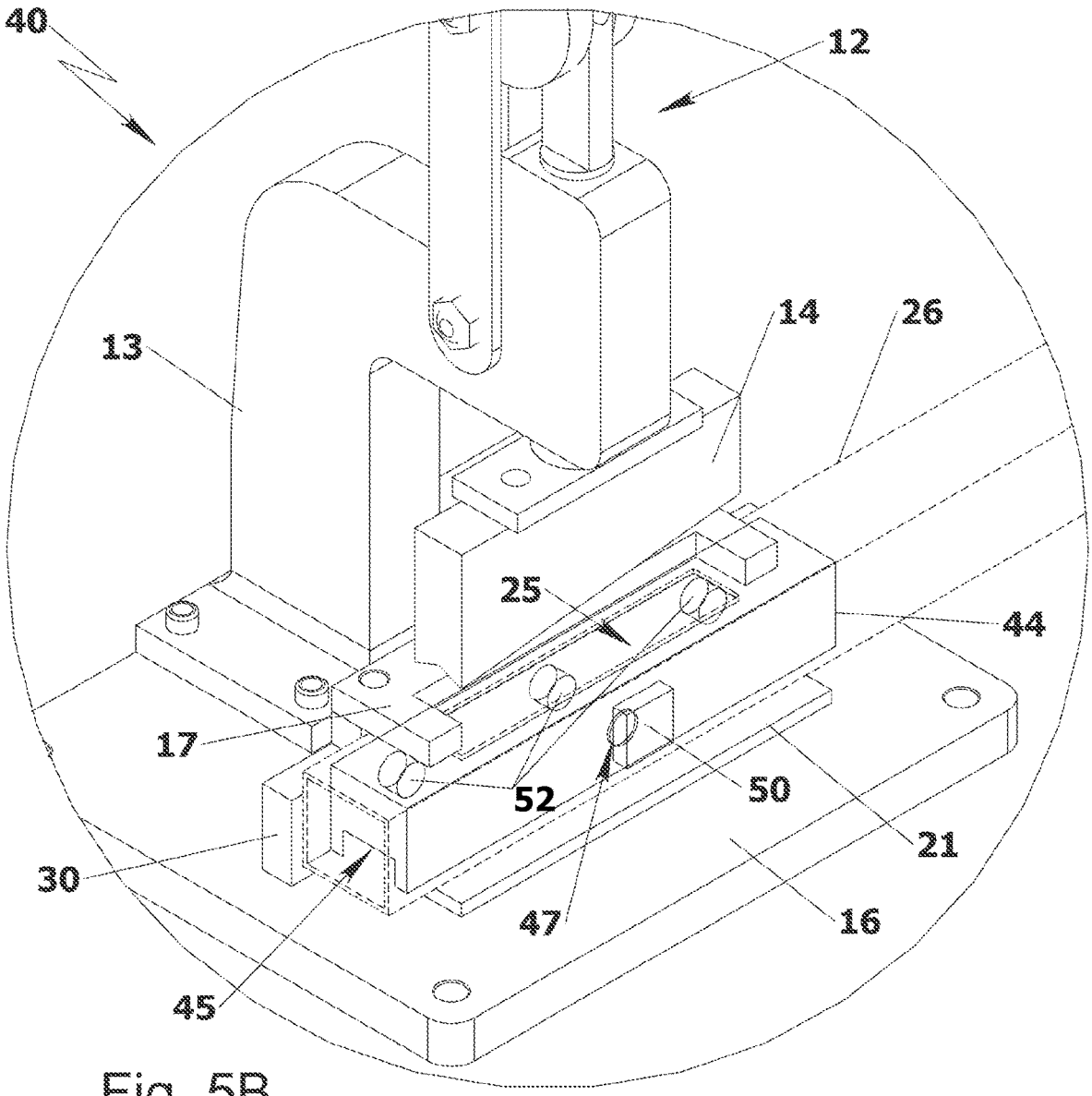
FIG. 5B is an enlarged isometric view of a portion of the manually driven press punching machine in accordance with some embodiments of the present invention, for punching apertures in elongated enclosed profiled workpieces, showing the female die matrix within the loaded workpiece.
Figure 6:
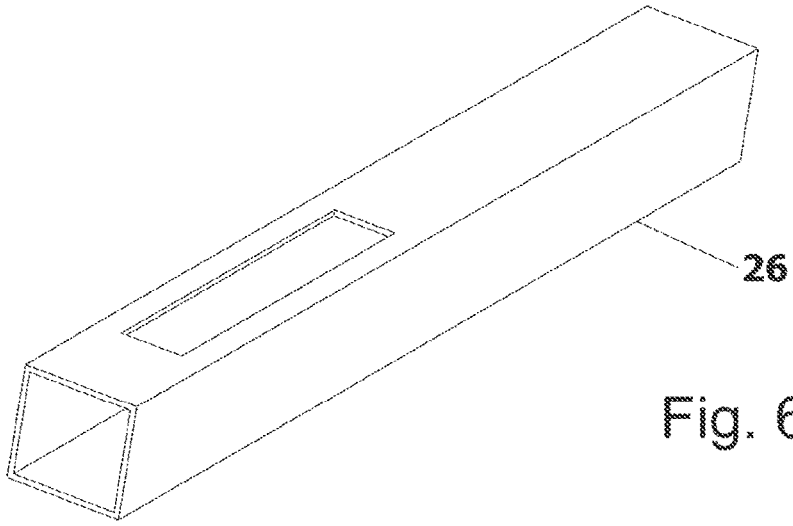
FIG. 6 is an isometric view of the finished workpiece with aperture cut therein.

Consequently upon threading polygonal female punch die matrix 44, shown in FIGS. 4A to 5B, into elongated non-ferric enclosed polygonally profiled workpiece 26, magnets 52, positioned within the side portion of polygonal female punch die matrix 44, facing back-side plate 30 of device 40, interact with magnets 42, within back-side plate 30 shown in FIG. 3. As the result of the aforementioned interaction between magnets 52 in the side portion of polygonal female punch die matrix 44 and magnets 42 within back-side plate 30 of device 40, polygonal female punch die matrix 44 is become longitudinally aligned within elongated non-ferric enclosed polygonally profiled workpiece 26, so that counter-opening 25 in polygonal female punch die matrix 44 is positioned aligned vis-à-vis male punch die 14; thereby sustaining the performing of press punching operation. As elongated non-ferric enclosed polygonally profiled workpiece 26 is translated along back-side plate 30, polygonal female punch die matrix 44 remains respectively positioned aligned vis-à-vis male punch die 14.

Moreover, in accordance with some preferred embodiments of the present invention, additionally to magnets 52 within the side portion of polygonal female punch die matrix 44 facing towards back-side plate 30 of device 40, which are used to position and align polygonal female punch die matrix 44, within elongated non-ferric enclosed polygonally profiled workpiece 26, correctly relatively to male die 14 of device 40, polygonal female punch die matrix 44 shown in FIGS. 4A to 5B comprises at least one indicatory magnet 47, embedded within the side portion of polygonal female punch die matrix 44 facing away from back-side plate 30 of device 40. Indicatory magnet 47, embedded within the side portion of polygonal female punch die matrix 44 facing away from back-side plate 30 of device 40 is used to indicate the presence as well as correct position and alignment of polygonal female punch die matrix 44, within elongated non-ferric enclosed polygonally profiled workpiece 26.

Device 40 preferably further comprises at least magnetically sensitive and/or interactive element 50 employed to indicate and/or verify the presence as well as correct position and alignment of polygonal female punch die matrix 44, within elongated non-ferric enclosed polygonally profiled workpiece 26. In the example of device 40 the at least magnetically sensitive and/or interactive element is counterpoised magnet 50 that is positioned on the front side of elongated non-ferric enclosed polygonally profiled workpiece 26. As elongated non-ferric enclosed polygonally profiled workpiece 26 is translated along back-side plate 30, polygonal female punch die matrix 44 may occasionally get stuck or jammed within enclosed polygonally profiled workpiece 26, as a result polygonal female punch die matrix 44 get translated therewith, despite the interaction between magnets 52 in the side portion of polygonal female punch die matrix 44 and magnets 42 within back-side plate 30 of device 40.

Consequently if polygonal female punch die matrix 44 is stuck or jammed within enclosed polygonally profiled workpiece 26 and consequently is translated therewith, counterpoising magnet 50 remains to be positioned on the front side of elongated non-ferric enclosed polygonally profiled workpiece 26 vis-à-vis polygonal female punch die matrix 44. Therefore if polygonal female punch die matrix 44 is stuck or jammed within enclosed polygonally profiled workpiece 26 and consequently is not positioned aligned vis-à-vis male punch die 14, counterpoising magnet 50 will indicate that counter-opening 25 in polygonal female punch die matrix 44, is not positioned aligned vis-à-vis male punch die 14.

It should be acknowledged that in the embodiment of device 40, counterpoising magnet 50 is merely exemplary magnetically sensitive and/or interactive element employed to indicate and/or verify the presence as well as correct position and alignment of polygonal female punch die matrix 44, within elongated non-ferric enclosed polygonally profiled workpiece 26. In other embodiments, in lieu of a counterpoising magnet 50, a magnetic sensor (not shown) is positioned vis-à-vis indicatory magnet 47 of polygonal female punch die matrix 44, when counter-opening 25 in polygonal female punch die matrix 44 is aligned correctly relatively to male punch die 14.

In some examples the aforementioned magnetic sensor (not shown), actuated by indicatory magnet 47 in polygonal female punch die matrix 44, closes or interrupts an electric circuit powering a sensory indicator, such as an audible sound or visible light, indicatory of a correct and/or incorrect position of indicatory magnet 47 in polygonal female punch die matrix 44, within elongated non-ferric enclosed polygonally profiled workpiece 26, vis-à-vis the aforementioned magnetic sensor (not shown), while allowing to perform the punching operation. In some examples, however, the aforementioned magnetic sensor (not shown), actuated by indicatory magnet 47 in polygonal female punch die matrix 44, closes or interrupts an electric circuit controlling the entire operation of device 40. Accordingly if the position of indicatory magnet 47 in polygonal female punch die matrix 44, within elongated non-ferric enclosed polygonally profiled workpiece 26, is correct, namely aligned vis-à-vis the aforementioned magnetic sensor (not shown), the punching operation is performable; whereas if the position of indicatory magnet 47 in polygonal female punch die matrix 44, within elongated non-ferric enclosed polygonally profiled workpiece 26, is incorrect, namely not aligned vis-à-vis the aforementioned magnetic sensor (not shown), the performance of the punching operation is precluded.

In some preferred embodiments a simultaneous, namely a double-sided or triple-sided, punching operation is performed per single actuation of the punching machine of the present invention. A double-sided simultaneous punching operation is typically performed by either of the two techniques:

(a) by simultaneously punching an elongated non-ferric enclosed polygonally profiled workpiece by a set of two male dies from the opposite faces of the workpiece;

(b) by punching the elongated non-ferric enclosed polygonally profiled workpiece by a single male die through the first opposite face of the workpiece, throughout the interior of the workpiece and then through the second opposite face of the workpiece at once.

The first of the two aforementioned techniques of double-sided punching, namely simultaneously punching an elongated non-ferric enclosed polygonally profiled workpiece by a set of two male dies from the opposite faces of the workpiece, as well as a triple-sided punching technique, namely simultaneously punching an elongated non-ferric enclosed polygonally profiled workpiece by a set of two male dies from the opposite faces of the workpiece and additionally by a third male die from the upper face, have been disclosed in U.S. Pat. No. 6,601,492. The second of the two aforementioned techniques of double-sided punching, namely punching the elongated non-ferric enclosed polygonally profiled workpiece by a single male die through the first opposite face of the workpiece, throughout the interior of the workpiece and then through the second opposite face of the workpiece at once, requires a congruent geometry and location of the apertures on the opposite sides, a respective throughout counter-opening aperture in the polygonal female punch die matrix and an additional respective counter-opening in the pedestal, which act additionally as female punch die matrix for the aperture in the second opposite face of the workpiece. The second of the two aforementioned techniques of double-sided punching is further limited to male dies having a substantial thickness, since punching the workpiece throughout requires a male die having a substantial length, whereas relatively thin and long male dies tend not to possess an adequate physical strength or firmness and may broke or bent during the punching.

It is noted that in the instance of the first of the two aforementioned techniques of double-sided punching, namely simultaneously punching an elongated non-ferric enclosed polygonally profiled workpiece by a set of two male dies from the opposite faces of the workpiece, as well as in the instance of a triple-sided punching technique, namely simultaneously punching an elongated non-ferric enclosed polygonally profiled workpiece by a set of two male dies from the opposite faces of the workpiece and additionally by a third male die from the upper face, disclosed inter alia in U.S. Pat. No. 6,601,492, at least one magnet (not shown), in lieu of magnets 52 that are incorporated into the side portion of polygonal female punch die matrix 44 facing back-side plate 30 of device 40 and interacting with magnets 42 within back-side plate 30, is incorporated into the bottom portion of polygonal female punch die matrix 44 facing pedestal 21 of device 40 and interacting with at least one magnet 42 embedded into pedestal 21 of device 40, alternatively or additionally to magnets 42 within back-side plate 30. Indicatory magnet 47 is optionally embedded within polygonal female punch die matrix 44 in any location convenient for positioning the at least magnetically sensitive and/or interactive element, indicating the presence and correct position/alignment of polygonal female punch die matrix 44 within elongated non-ferric enclosed polygonally profiled workpiece 26, so that the at least magnetically sensitive and/or interactive element does not interfere with the process of feeding, processing and removing elongated non-ferric enclosed polygonally profiled workpiece 26 into, in and from device 40.

It is noted that in the instance of the second of the two aforementioned techniques of double-sided punching, namely by punching the elongated non-ferric enclosed polygonally profiled workpiece by a single male die through the first opposite face of the workpiece, throughout the interior of the workpiece and then through the second opposite face of the workpiece at once, as well as in the instance of a simple single-sided punching, namely by punching the elongated non-ferric enclosed polygonally profiled workpiece by a single male through the upper face of the workpiece, preferably female punch die matrix 44 comprises an array of driven magnets. Such at least one driven magnet 52 disposed on each opposite side portion of female punch die matrix 44. Accordingly device 40 additionally to at least one driving magnet 42 embedded into back-side plate 30 comprises at least one additional driving magnet (not shown) embedded into front-side plate (not shown) facing female punch die matrix 44 from the opposite side.

Moreover, such an array of driven magnets preferably embodies a symmetric configuration, namely for each driven magnet 52 embedded into the side portion of female punch die matrix 44 facing back-side plate 30, female punch die matrix 44 comprises an additional driven magnet (not shown) embedded into the side opposite portion of female punch die matrix 44 facing front-side plate (not shown), having an essentially similar size and/or magnetic field and disposed essentially symmetrically to driven magnet 52 embedded into the side portion of female punch die matrix 44 facing back-side plate 30, relatively to the longitudinal centerline of female punch die matrix 44. In such an array of driven magnets embodying a symmetric configuration, the pulling forces exerted onto driven magnet 52 embedded into the side portion of female punch die matrix 44 facing back-side plate 30 are substantially counterbalanced by the pulling forces exerted onto driven magnet (not shown) embedded into the side opposite portion of female punch die matrix 44 facing front-side plate (not shown), contributing to a more balanced array of forces exerted by the driving magnets onto female punch die matrix 44, consequently reducing the frictional force formed female punch die matrix 44 and elongated non-ferric enclosed polygonally profiled workpiece 26.

In some preferred embodiments (not shown) female punch die matrix 44 comprises at least one roller (not shown). An exemplary roller is a bearing the inner ring of which embedded into a side portion of matrix 44 and affixed thereto, whereas the exterior ring of the bearing outwardly protrudes beyond a surface of matrix 44, facing an inner face of elongated non-ferric enclosed polygonally profiled workpiece 26. Another exemplary roller is a cylindrically shaped member threaded onto a rotation axis. The rotation axis, onto which the cylindrically shaped member is threaded, is embedded into a side portion of matrix 44 and affixed thereto, whereas an exterior surface of the cylindrically shaped member outwardly protrudes beyond a surface of matrix 44, facing an inner face of elongated non-ferric enclosed polygonally profiled workpiece 26. Upon threading female punch die matrix 44 into elongated non-ferric enclosed polygonally profiled workpiece 26, an exterior portion of the roller protruding beyond a surface of matrix 44 engages the inner face of elongated non-ferric enclosed polygonally profiled workpiece 26. Consequently, the rollers embedded into female punch die matrix 44 sustain fluent longitudinal translation of female punch die matrix 44 within elongated non-ferric enclosed polygonally profiled workpiece 26, because the aforementioned longitudinal translation is sustained by the rotation of the rollers rather than by frictional contiguous displacement of a exterior surface of female punch die matrix 44 over the inner face of elongated non-ferric enclosed polygonally profiled workpiece 26.

Accordingly by employing the aforementioned rollers, the frictional force formed upon longitudinal translation of female punch die matrix 44 within elongated non-ferric enclosed polygonally profiled workpiece 26 is virtually obviated; thereby effectively reducing the chances of polygonal female punch die matrix 44 becoming stuck or jammed within enclosed polygonally profiled workpiece 26. In some preferred embodiments, the aforementioned at least one roller is disposed on the side portion of polygonal female punch die matrix 44 which incorporates driven magnets 52 and faces the driving magnets 42. Driven magnets 52 embedded into the side portion of polygonal female punch die matrix 44, as well as driving magnets 42 embedded into press punching machine 40, used to position and align polygonal female punch die matrix 44, within elongated non-ferric enclosed polygonally profiled workpiece 26, shown in FIGS. 3 to 5B comprise bar shaped magnets. Driven magnets 52 embedded into the side portion of polygonal female punch die matrix 44, as well as driving magnets 42 embedded into press punching machine 40, are optionally arranged so that the cross-section of driven magnets 52 faces the cross-section of driving magnets 42. In the aforementioned constellation, namely where the cross-section of driven magnets 52 faces the cross-section of driving magnets 42, the orientation of the magnetic dipole moment and the longitudinal centerlines of both bar magnets is aligned essentially collinearly, so that the opposite poles of both magnets facing vis-à-vis each other. Moreover in the aforementioned constellation, the longitudinal centerline of driven magnets 52 and driving magnets 42 are oriented essentially orthogonally to the face of polygonal female punch die matrix 44 into which driven magnets 52 are embedded.

In some preferred embodiments (not shown), however, driven magnets 52 embedded into the side portion of polygonal female punch die matrix 44, as well as driving magnets 42 embedded into press punching machine 40, comprise bar shaped magnets, where the longitudinal centerlines thereof and the magnetic dipole moment are oriented in parallel to each other (not shown). Accordingly, in the aforementioned latter constellation, the orientation of the magnetic dipole moment of both bar magnets is aligned essentially in parallel, whereas the interaction between driven magnets 52 and driving magnets 42 is characterized not by an interaction between the opposite poles of collinearly aligned driven magnet 52 and driving magnet 42 but rather by an interaction of the magnetic field formed between the opposite poles along driven magnet 52 with the magnetic field formed between the opposite poles along driving magnet 42. Moreover in the aforementioned latter constellation, the longitudinal centerline of driven magnets 52 and driving magnets 42 are oriented essentially in parallel to the face of polygonal female punch die matrix 44 into which driven magnets 52 are embedded.

In some yet further preferred embodiments, where driven magnet 52 and driving magnets 42 are oriented longitudinally in parallel to each other (not shown) and where the interaction between driven magnets 52 and driving magnets 42 is characterized by an interaction of the magnetic field formed between the opposite poles along driven magnet 52 with the magnetic field formed between the opposite poles along driving magnet 42 at least the driven magnet 52 or driving magnet 42 are provided with a mechanism sustaining the rotation thereof about the longitudinal centerline. For instance, driving magnet 42 and/or driven magnet 52 optionally embody a cylindrical bar shape which is threaded onto a rotational axis, which is affixed to press punching machine 40 and/or female punch die matrix 44 respectively, sustaining the rotation of driving magnet 42 and/or driven magnet 52 on the rotational axis (not shown) about the longitudinal centerline thereof. It is noted that driving magnets 42 and/or driven magnets 52 threaded onto a rotational axis are neither used nor act as rollers, rather that rotation of the driving magnets 42 and/or driven magnets 52 facilitates assuming the correct angular position of driving magnets 42 relatively to driven magnets 52.

In some preferred embodiments (not shown), one or plurality of press punching machine/s of the present invention is/are implemented in an integrated and automated production line. Since the press punching machines of the present invention is particularly configured for forming apertures in elongated non-ferric enclosed polygonally profiled workpieces, the workpiece is optionally affixed, whereas one or plurality of punching machines of the present invention is/are movable along the workpiece.

What is claimed is:

1. A press punching machine for punching apertures in elongated non-ferric enclosed polygonally profiled workpieces, said press punching machine comprises:

(a) a planar base plate;

(b) a mounting framework attached to said base plate;

(c) a driving mechanism attached to said mounting framework;

(d) at least one male die operatively connected to said driving mechanism;

(e) a pedestal attached to said base plate, said pedestal is configured to support an elongated non-ferric enclosed polygonally profiled workpiece during a punching operation;

(f) a polygonal female die matrix comprising:

(I) a polygonal cross-section configured to conform to at least a portion of an interior cross-section of said elongated non-ferric enclosed polygonally profiled workpiece;

(II) at least one counter-opening configured to receive said at least one male die during the punching operation;

(III) at least one driven magnet embedded into a side portion of said polygonal female die matrix, the at least one driven magnet is configured to drive said polygonal female die matrix within said elongated non-ferric enclosed polygonally profiled workpiece;

(g) at least one driving magnet configured to interact with said at least one driven magnet embedded into said side portion of said polygonal female die matrix; said at least one driving magnet is embedded into at least one member selected from the group consisting of: a back-side plate of said press punching machine and said pedestal;

(h) at least one feedback-indicatory magnet embedded into said polygonal female die matrix, configured to provide a feedback-indication that said polygonal female die matrix is in a correct position within said elongated non-ferric enclosed polygonally profile workpiece, wherein said at least one feedback-indicatory magnet faces away from said at one least driven magnet, wherein when said polygonal female die matrix is driven within said elongated non-ferric enclosed polygonally profiled workpiece into said correct position, said feedback-indicatory magnet is positioned on a side of said polygonal female die matrix which is not adjacent to any of said at least one driving magnet;

(i) at least one magnetically feedback-indicative member selected from the group consisting of: a magnetically sensitive element and a magnetically interactive element; said at least one magnetically feedback-indicative member is configured to interact with or be actuated by said at least one feedback-indicatory magnet embedded into said polygonal female die matrix;

wherein upon threading said polygonal female die matrix into said elongated non-ferric enclosed polygonally profiled workpiece, said at least one driven magnet embedded into said side portion of said polygonal female die matrix interacts with said at least one driving magnet embedded into said at least one member selected from the group consisting of: said back-side of said press punching machine and said pedestal;

wherein upon aforesaid interaction between said at least one driven magnet with said at least one driving magnet, said polygonal female die matrix is driven within said elongated non-ferric enclosed polygonally profiled workpiece into the correct position, wherein said at least one counter-opening in said polygonal female die matrix is aligned vis-a-vis said at least one male die;

wherein said press punching machine does not comprise an elongated rod to position said polygonal female die matrix within said elongated non-ferric enclosed polygonally profiled workpiece;

wherein upon driving said polygonal female die matrix, within said elongated non-ferric enclosed polygonally profiled workpiece, into said correct position, said at least one magnetically feedback-indicative member interacts with and/or is actuated by said at least one feedback-indicatory magnet, thereby providing said feedback-indication that said at least one counter-opening in said polygonal female die matrix is in said correct position and aligned vis-a-vis said at least one male die;

wherein when said polygonal female die matrix is positioned in said correct position within said elongated non-ferric enclosed polytonally profile workpiece, said at least one driving magnet faces toward the at least one driven magnet.

2. The press punching machine according to claim 1, wherein said at least one driving magnet is embedded into said back-side plate of said press punching machine and wherein said side portion of said polygonal female die matrix, into which said at least one driven magnet is embedded, is a lateral side portion of said polygonal female die matrix.

3. The press punching machine according to claim 1, wherein said at least one driving magnet is embedded into said pedestal.

4. The press punching machine, according to claim 1, wherein at least one member selected from the group consisting of: said at least one driving magnet and said at least one driven magnet, embodies a cylindrical shape and wherein the press punching machine is characterized by that said at least one driving magnet and said at least one driven magnet are oriented coaxially or in parallel.

* * * * *